US009589415B2

(12) United States Patent
Montenegro et al.

(10) Patent No.: US 9,589,415 B2
(45) Date of Patent: Mar. 7, 2017

(54) GAMING MACHINE AND METHOD TO EFFECT INFORMATION TRANSFER BETWEEN A GAMING MACHINE AND AN EXTERNAL DEVICE

(71) Applicant: Atlas Gaming Technologies Pty. Ltd., Port Melbourne (AU)

(72) Inventors: Daniel Julio Montenegro, Port Melbourne (AU); Zenja Solaja, Port Melbourne (AU); Robert Sloot, Port Melbourne (AU); Alessandro Ciampoli, Port Melbourne (AU); Boris Mitelman, Port Melbourne (AU); Wade Clark, Port Melbourne (AU)

(73) Assignee: Atlas Gaming Technologies Pty Ltd. (AU)

( * ) Notice: Subject to any disclaimer, the term of this patent is extended or adjusted under 35 U.S.C. 154(b) by 82 days.

(21) Appl. No.: 14/251,594

(22) Filed: Apr. 12, 2014

(65) Prior Publication Data

US 2015/0072767 A1 Mar. 12, 2015

(30) Foreign Application Priority Data

Apr. 13, 2013 (AU) ..... 2013901281

(51) Int. Cl.
*G07F 17/32* (2006.01)

(52) U.S. Cl.
CPC ..... *G07F 17/3211* (2013.01); *G07F 17/3218* (2013.01); *G07F 17/3241* (2013.01); *G07F 17/3244* (2013.01); *G07F 17/3269* (2013.01)

(58) Field of Classification Search
CPC ..... G07F 17/32
See application file for complete search history.

(56) References Cited

U.S. PATENT DOCUMENTS

| | | | | |
|---|---|---|---|---|
| 2007/0222452 | A1* | 9/2007 | Miyake | A63F 13/12 324/332 |
| 2013/0005474 | A1* | 1/2013 | Bethke | A63F 13/12 463/42 |
| 2013/0023339 | A1* | 1/2013 | Davis | G07F 17/3206 463/29 |

* cited by examiner

*Primary Examiner* — Omkar Deodhar
(74) *Attorney, Agent, or Firm* — Lerner, David, Littenberg, Krumholz & Mentlik, LLP

(57) ABSTRACT

Embodiments relate to gaming machines and methods to be performed in relation to gaming machines. An example gaming machine comprises: a display screen; an input mechanism operable to receive an input from a user; a gaming controller configured to: (i) control a game play sequence comprising a presentation of one or more games of chance on the gaming machine; and (ii) in response to the received input from the user, generate and encrypt visual code from a set of data and display the encrypted visual code on the display screen, wherein the encrypted visual code includes a timestamp; wherein the displayed encrypted code is able to be captured by an external handheld device, and the visual code is dynamically re-generated upon each successive input from a user made through the input mechanism.

17 Claims, 7 Drawing Sheets

GAMING MACHINE AND METHOD TO EFFECT INFORMATION TRANSFER BETWEEN A GAMING MACHINE AND AN EXTERNAL DEVICE

CROSS-REFERENCE TO RELATED APPLICATIONS

The present application claims priority from Australian Provisional Patent Application No 2013901281 filed on 13 Apr. 2013, the content of which is incorporated herein by reference.

TECHNICAL FIELD

Described embodiments generally relate to systems and methods for the transfer of information between gaming machines and external devices. In particular, described embodiments are directed to a system of transferring auditing and metering information from gaming machines to external computer systems using encrypted QR codes.

BACKGROUND

In the gaming machine industry, it is common, and often a legal requirement, that the machines record and store various forms of auditing and metering data. Such data may include the machine serial number, the game name, game statistics such as the amount won or lost over time, and the number of games played over particular time periods, for example. The data may be stored on a hard or soft meter. This data is useful to a number of different entities. For example, the local operator/owner of the machine may require the data for accounting or taxation purposes. A regulatory body may require access to maintain jurisdictionally controlled standards in the industry. Additionally, the designers of the game may be interested in the information for future game development purposes—for example, they may be able to see which game options were most often chosen, and so form a better view on the types of options game players preferred.

In some instances, the information is automatically sent to the local operator/owner electronically, and the gaming machines may be automated to periodically send the data to the appropriate regulatory body or monitoring agency. Some venues, however, are not electronically connected to a monitoring agency. In these cases, to enter the information into other computer systems it is often necessary to manually note down the required information by hand, then manually input it into the required system or database. It is apparent that this manual transferral of information from one medium to another is prone to error. This may cause undesirable consequences, as it is important to keep record of accurate data. This often sensitive data is also prone to the misappropriation by others, whether innocently or maliciously.

It is desired to address or ameliorate one or more shortcomings or disadvantages associated with prior systems for the transfer of auditing and metering information from gaming machines, or to at least provide a useful alternative thereto.

Any discussion of documents, acts, materials, devices, articles or the like which has been included in the present specification is not to be taken as an admission that any or all of these matters form part of the prior art base or were common general knowledge in the field relevant to the present disclosure as it existed before the priority date of each claim of this application.

Throughout this specification the word "comprise", or variations such as "comprises" or "comprising", will be understood to imply the inclusion of a stated element, integer or step, or group of elements, integers or steps, but not the exclusion of any other element, integer or step, or group of elements, integers or steps.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

Some embodiments relate to a gaming machine is provided, the gaming machine comprising:

- a display screen;
- an input mechanism operable to receive an input from a user;
- a gaming controller configured to:
  - (i) control a game play sequence comprising a presentation of one or more games of chance on the gaming machine; and
  - (ii) in response to the received input from the user, generate and encrypt visual code from a set of data and display the encrypted visual code on the display screen, wherein the encrypted visual code includes a timestamp;
- wherein the displayed encrypted code is able to be captured by an external handheld device, and the visual code is dynamically re-generated upon each successive input from a user made through the input mechanism.

The generated visual code may be a QR code.

In one embodiment the timestamp may be appended to the visual code after encryption. In a further embodiment the timestamp may be appended to the visual code before encryption.

The set of data may comprise a portion of the data displayed on the display screen at the time the user activates the control mechanism. Optionally the set of data may comprise all of the data which is displayed on the display screen at the time the user activates the control mechanism. In a non-limiting example, the set of data may comprise values shown on the display screen representative of metering data, for instance, the hard meter, turnover, total wins, money in, money out and bonus earned during the playing of the game. In a further non-limiting example, the set of data may comprise values shown on the display screen representative of an amount of money bet and won in a particular game, and an amount of money accumulated during the particular game.

The input mechanism may comprise one or more electromechanical pushbuttons and/or one more soft keys, otherwise known as a soft button or virtual button.

The external handheld device may run an application which is configured to automatically communicate a captured image to an independent device upon capture of the image. The external handheld device may be operable to communicate with the independent device wirelessly.

Some embodiments relate to a method for controlling the transfer of data from a gaming machine is provided, the method comprising:

- receiving input from a user of the gaming machine; in response to the received user input generating visual code from a set of data;

associating a timestamp with the visual code and encrypting the generated visual code;

displaying the encrypted visual code on a display screen of the gaming machine;

wherein the displayed encrypted code is operable to be captured by an external handheld device, and visual code is dynamically re-generated upon each successive input from a user made via the input mechanism. In some embodiments, generating the visual code may comprise generating a QR code.

Generating the visual code from the set of data may comprise generating the visual code from a portion of the data displayed on the display screen at a time that the user activates the control mechanism. Generating the visual code from the set of data may alternatively or additionally generating the visual code from all of the data which is displayed on the display screen at the time that the user activates the control mechanism In some embodiments, generating the visual code from the set of data may comprise generating the visual code from values shown on the display screen representative of metering data. Generating the visual code from the set of data may comprise generating the visual code from values shown on the display screen representative of at least one of an amount of money bet in a particular game; and amount of money in a particular game; and an amount of money accumulated during a particular game.

Some embodiments relate to a method for receiving data from a gaming machine using a handheld device is further provided, the method comprising:

capturing an image of an unique encrypted visual code displayed on a portion of a display screen of a gaming machine, the visual code representative of a set of data;

establishing a wireless modem connection with a remote computing device;

transmitting the captured image to the remote computing device via the wireless modem;

unencrypting the visual code and retrieving the set of data; and terminating the wireless modem connection with the remote computing device.

The method may include storing the captured image to memory in the handheld device.

It should be noted that any of the various features of the above subject of the application can be combined as suitable and desired.

BRIEF DESCRIPTION OF DRAWINGS

Embodiments are described in further detail below, by way of example and with reference to the accompanying drawings, in which.

DETAILED DESCRIPTION

Described embodiments generally relate to systems and methods for the transfer of information between gaming machines and external devices. In particular, described embodiments are directed to a system of transferring auditing and metering information from gaming machines to external computer systems using encrypted QR codes containing such auditing and metering information.

Figure 1:
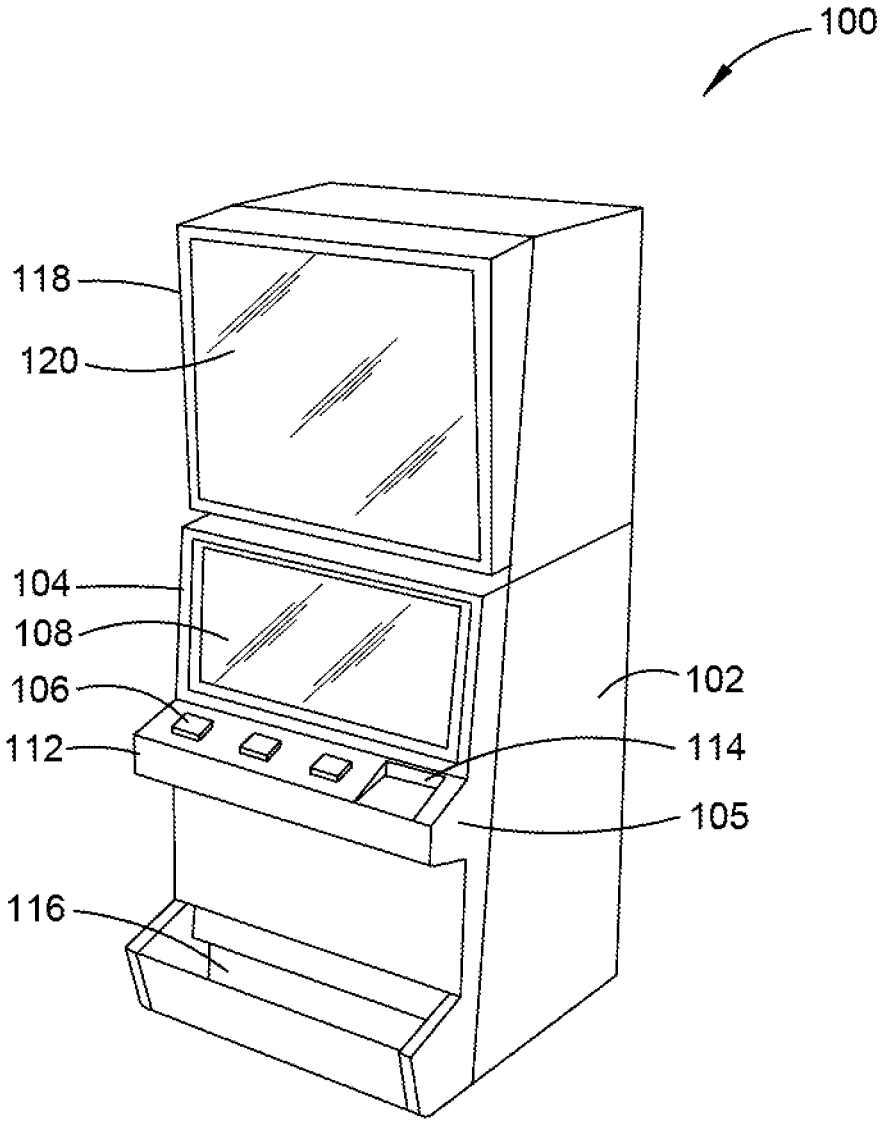
FIG. 1 shows a perspective view of a gaming machine.

In FIG. 1, reference numeral 100 generally designates a stand-alone gaming system including a game. By stand-alone the applicant is referring to a system which can operate by itself with a player and which requires no further interaction from other systems. Hereinafter, the stand-alone gaming system 100 will be referred to as a gaming machine.

The gaming machine 100 includes a console 102 which contains all or most components required to implement a game play whereby a player wins or loses a wager. Access to the components is by way of a hinged door 105. Moulded to the exterior of the console 102 is a display means in the form of at least one visual display unit 104 on which one or more games is played. The video display unit 104 may be implemented as a liquid crystal display, a plasma screen, as a cathode ray screen device or the like. Whilst the console 102 illustrated in FIG. 1 shows a single visual display unit 104, there can be more than one visual display unit on a typical machine. What is displayed on the visual display unit 104 will depend on what the intended goal of the unit is in relation to the player and any other potential participants in the gaming system.

The gaming machine includes a tactile input for a player to interact via touch with the gaming machine 100. In this example, the tactile input is in the form of a combination of pushbuttons 106 and a touch screen 108 for enabling a player to play one or more games. The touch screen is an electronic visual display that can detect the presence and location of a touch within the display area. The touch screen 108 is used during the game play between start of a game and the end of a game. A game is considered to have started once a wager is placed and considered complete once the wager has been lost or won. Certain functions of the pushbutton are: initiation of game play, credit output, gameplay selection, completion of gameplay etc. A midtrim 112 of the machine 100 houses the pushbuttons 106.

The tactile input may optionally or further include a joystick comprising of a stick that pivots on a base and reports its angle or direction to the device it is controlling. The tactile input may optionally or further include a trackpad/touchpad being a pointing device featuring a tactile sensor to translate the motion and position of a user's fingers to a relative position on screen.

It should be appreciated that tactile input may include any suitable device that enables the player to produce an input signal that is received by the processor. Tactile input in the form of pushbuttons 106 and/or regions on touch screen 108 may include a one bet button, a max bet button, or a repeat the bet button. With a one bet button for instance, the player places a bet by pushing the one bet button. The player may increase the bet by one credit each time the player pushes the bet one button.

The midtrim 112 also houses credit input device including a bill collector 114. The credit input device may further include a coin input chute, a card and/or ticket reader, a magnetic reading head for reading a magnetic stripe card, an electronic reader for a proximity card, a near field communications reader or any other form of electronic, wireless or contact that can input credit to the gaming machine.

A credit dispenser in the form of a coin tray 116 is mounted beneath the console 102 and is provided for cash payouts from the machine 100 to the player. A hopper device (not shown) is provided which dispenses coins, or tokens equal to the amount of credit currently on the machine, into the coin tray 116. Aside from the coin tray 116, the credit dispenser may also include a ticket dispenser for issuing a ticket dispensed by a printer (not shown) which the user can redeem for cash, a note dispenser, a near field communications transmitter or means to enable remote credit transfer. It should be appreciated that any suitable payout mechanisms, such as funding to the player's electronically recordable identification card or smart card, may be implemented in accordance with the gaming machine disclosed herein. The printer may also be used to print receipts, game credits or player bonuses.

The gaming machine 100 includes a top box 118 on which artwork 120 is carried in the form of electronic visual display units. The artwork 120 could also be made from physical materials such as paper, plastic banners or posters. The artwork 120 may have generic information related to the machine or gaming system or the artwork 120 be specifically made for a particular game to be played on the machine 100. Whilst the artwork 120 is shown as being carried on the top box 118 the art work 120 can also be positioned in or on the bottom panel of the door 105, or any other part of the gaming machine 100 visible to the player.

The gaming machine 100 further includes an auditory unit in the form of speakers (not shown) to provide auditory feedback to the player of the gaming machine 100.

Figure 2:
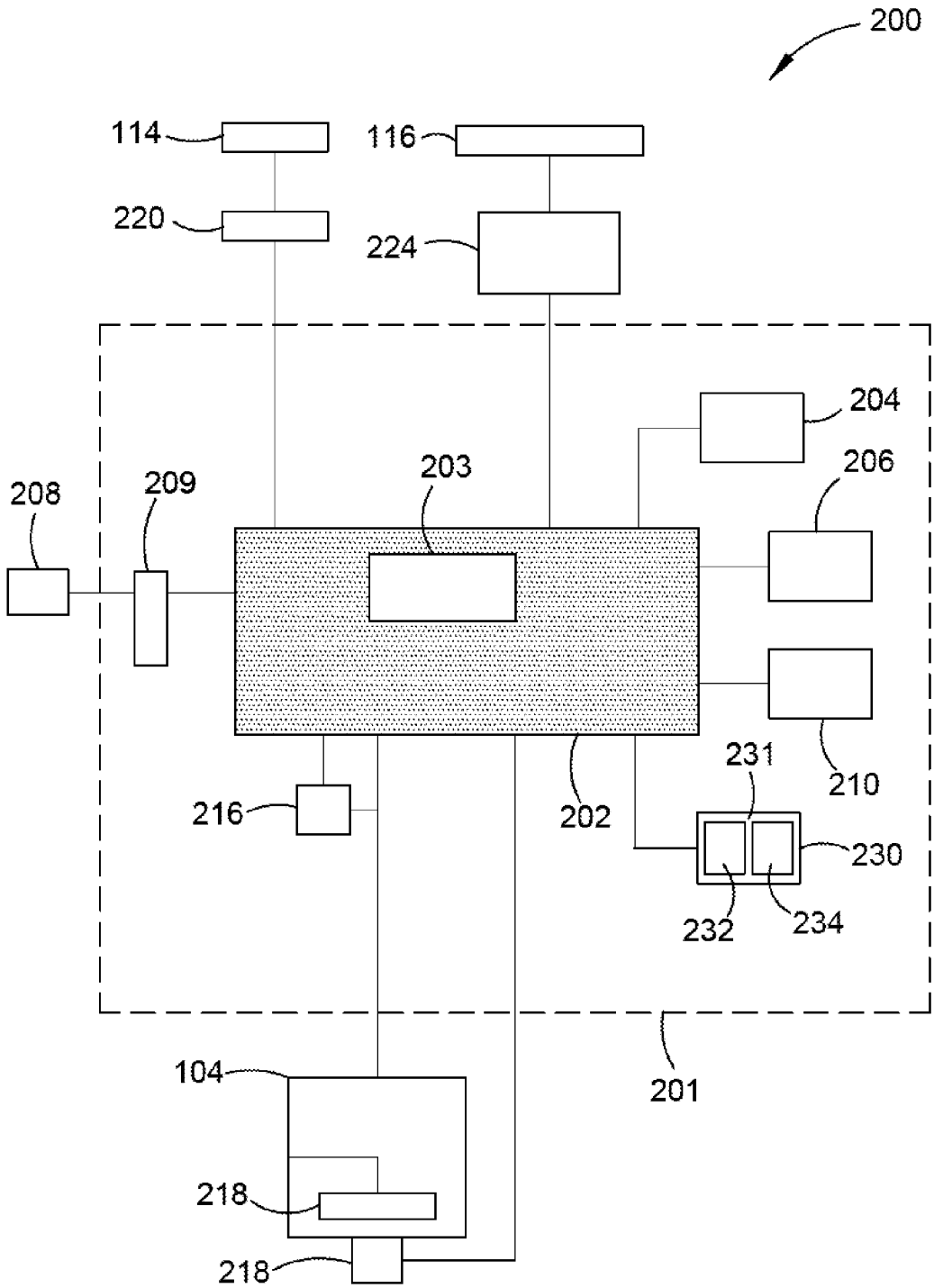
FIG. 2 shows a block diagram of a game logic circuit of the gaming machine illustrated in FIG. 1.

Referring to FIG. 2 of the drawings, game logic circuitry 200 is illustrated. The game logic circuitry 200 includes a gaming controller 201 (otherwise referred to as a logic cage) designated by the dashed lines. As will be appreciated by those skilled in the gaming industry, the logic cage 201 includes a box-like mechanical structure that has slots to guide logic cards into the proper location for electronically plugging into a backplane mounted at the rear of the cage structure. The backplane has connectors for accepting mating connectors on the logic cards. The logic cage and associated cards form one of the basic components of the gaming machine 100 and is securely housed within the cabinet of the gaming machine 100.

Central to the logic cage is a central processing unit 202 such as a processor, a microcontroller-based platform, a suitable integrated circuit, or one or more application-specific integrated circuits (ASIC's). The processor 202 is in communication with or operable to access or to exchange signals with at an outcome evaluator 203, RAM 204, ROM 206, a non-volatile memory in the form of a compact flash 230, an audio output 208 via an audio control module 209, and a random number generator 210. The audio control module 209 has its own digital signal processor, analogue to digital converters, amplifiers and other circuitry necessary to broadcast the output from the speakers. RAM 204 may include non-volatile RAM (NVRAM), magnetic RAM (MRAM), ferroelectric RAM (FeRAM), and other forms as commonly understood in the gaming industry.

Compact flash memory 230 is physically secured within a slot in the logic cage 201. In one embodiment, the compact flash memory 230 is physically secured inside the logic cage within game logic circuitry 200 by a mechanical locking mechanism. Compact flash memory 230 is partitioned 231 into two parts. A first part comprises a game software module 232 and a second part comprises a hard meter information module 234.

The processor 202 runs executable code residing in game software module 232 of compact flash 230 that facilitates play of the game by a player through the display device and/or push buttons and touch sensors mounted in the screen of the display. Hard meter information module 234 contains the gaming machine parameters which include values that would usually be stored on a hard meter. The values in hard meter information module 234 are only ever incremented, and cannot be reset or decremented. The only way to alter the values stored is by running the executable code stored in game software module 232, which is executed by processor 202. The executable code further interacts with the credit dispenser 116 via a payout mechanism 224 and the auditory output 208. The game software module 232 contains the rules of the game, the sequence of gameplay, communicates with external systems, monitors peripheral equipment, maintain integrity of the software code, etc. The processor 202 continually checks for error conditions.

A program which implements the game logic circuitry 200 and the user interface is further run by the central processing unit 202. The processor 202 forms part of a controller 216 that drives the screen of the video display unit 104 and that receives input signals from sensors 218. The sensors 218 include sensors associated with the push buttons and touch sensors mounted in the screen of the video display unit 104. The controller 214 also receives input pulses from mechanisms 220 and 224 to determine whether or not a player has provided sufficient credit from either payment device 114 or payment device 116 to commence playing.

In one embodiment, a player may insert an identification card into a card reader (not shown) of the gaming machine 100. Such an identification card may be a smart card having a programmed microchip, a coded magnetic strip, or coded rewritable magnetic strip, wherein the programmed microchip or magnetic strips are coded with a player's identification, credit totals (or related data), and/or other relevant information. In another embodiment, a player may carry a portable device, such as a mobile device, a radio frequency identification tag, or any other suitable wireless device, that communicates a player's identification, credit totals (or related data), and other relevant information to the gaming device.

One or more of the method steps described in this disclosure may be implemented by executable instructions and parameters 232, 234, stored in the memory 204, 206, 230, that may form software embodiments of the system 100. These instructions 232, 234 that form the system 100 may be executed by the CPU 202 or any other processor. Further, the processor 202, the memory 204, 206, 230, the instructions 232, 234 stored therein, or a combination thereof may serve as a means for performing one or more of the method steps described herein.

Figure 3:
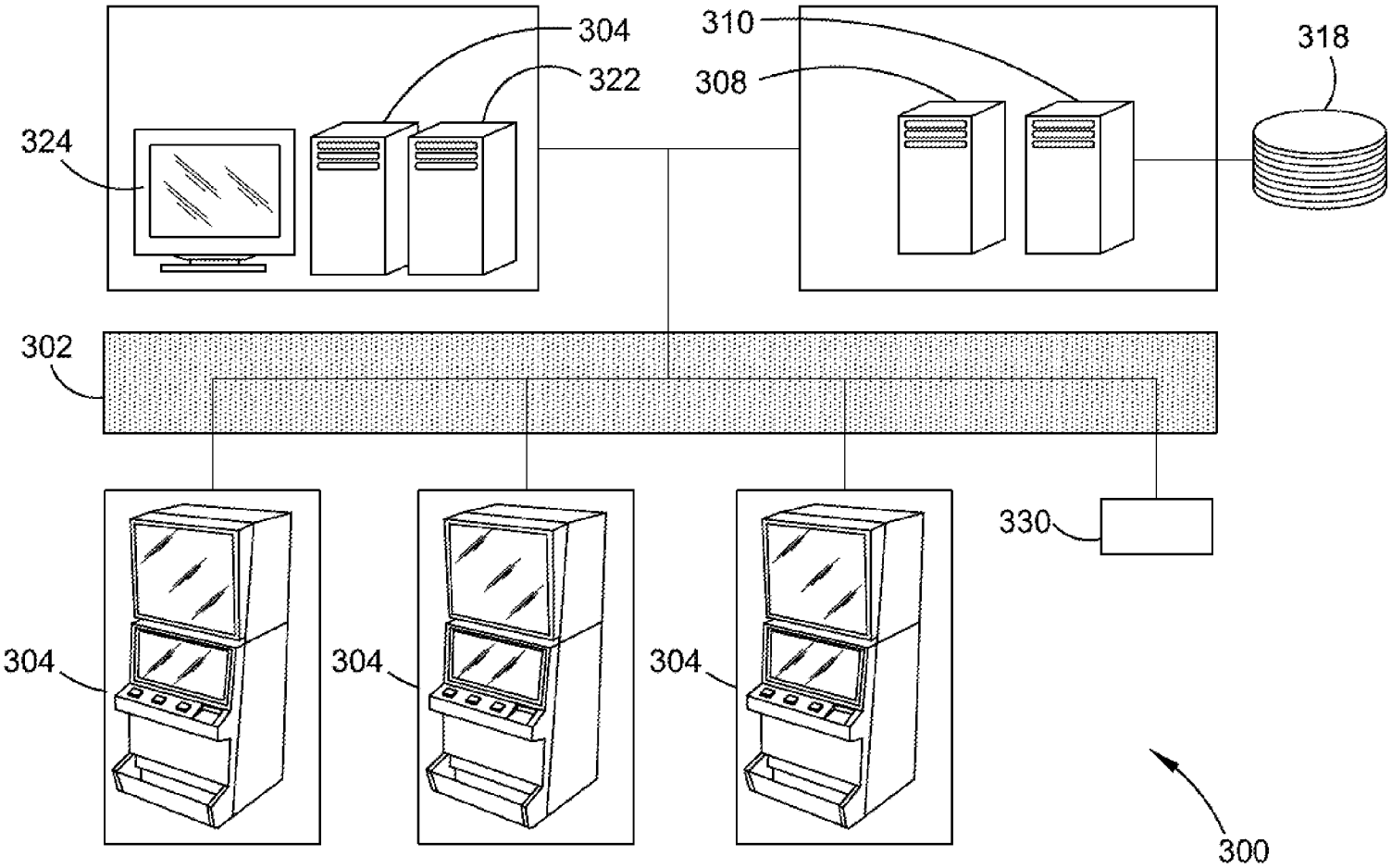
FIG. 3 shows a block diagram of functional components of a gaming system incorporating gaming machines illustrated in FIG. 1.

FIG. 3 shows a gaming system 300 in accordance with an alternative embodiment. The gaming system 300 includes a network 302, which for example may be an Ethernet network. The network 302 may also comprise a wide area network ("WAN"), the plain-old-telephone-system ("POTS), a local area network ("LAN"), a wireless LAN, the Internet, or any combination of these and other types of networks. Gaming machines 304 are connected to the network 302. The gaming machines 304 provide a player operable interface and may be the same as the gaming machines 100 shown in FIG. 1 or may have simplified functionality depending on the requirements for implementing game play.

In a thick client embodiment, game server 308 implements part of the game played by a player using a gaming machine 304 and the gaming machine 304 implements part of the game. With this embodiment, as both the game server 308 and the gaming device implement part of the game, they collectively provide a game controller. A database management server 310 may manage storage of game programs and associated data for downloading or access by the gaming devices 304 in a database 318.

In a thin client embodiment, game server 308 implements most or all of the game played by a player using a gaming machine 304 and the gaming machine 304 essentially provides only the player interface. With this embodiment, the game server 308 provides the game controller. The gaming machine will receive player instructions, pass these to the game server which will process them and return game play outcomes to the gaming machine for display. In a thin client embodiment, the gaming machines could be computer terminals, e.g. PCs running software that provides a player interface operable using standard computer input and output components.

Servers are also typically provided to assist in the administration of the gaming network 300, including for example a gaming floor management server 320, and a licensing server 322 to monitor the use of licenses relating to particular games. An administrator terminal 324 is provided to allow an administrator to run the network 302 and the devices connected to the network.

The gaming system 300 may communicate with other gaming systems, other local networks, for example a corporate network, and/or a wide area network such as the Internet, for example through a firewall 330.

Persons skilled in the art will appreciate that in accordance with known techniques, functionality at the server side of the network may be distributed over a plurality of different computers. For example, elements may be run as a single "engine" on one server or a separate server may be provided. For example, the game server 308 could run a random generator engine. Alternatively, a separate random number generator server could be provided. Further, persons skilled in the art will appreciate that a plurality of game servers could be provided to run different games or a single game server may run a plurality of different games as required by the terminals.

Figure 4:
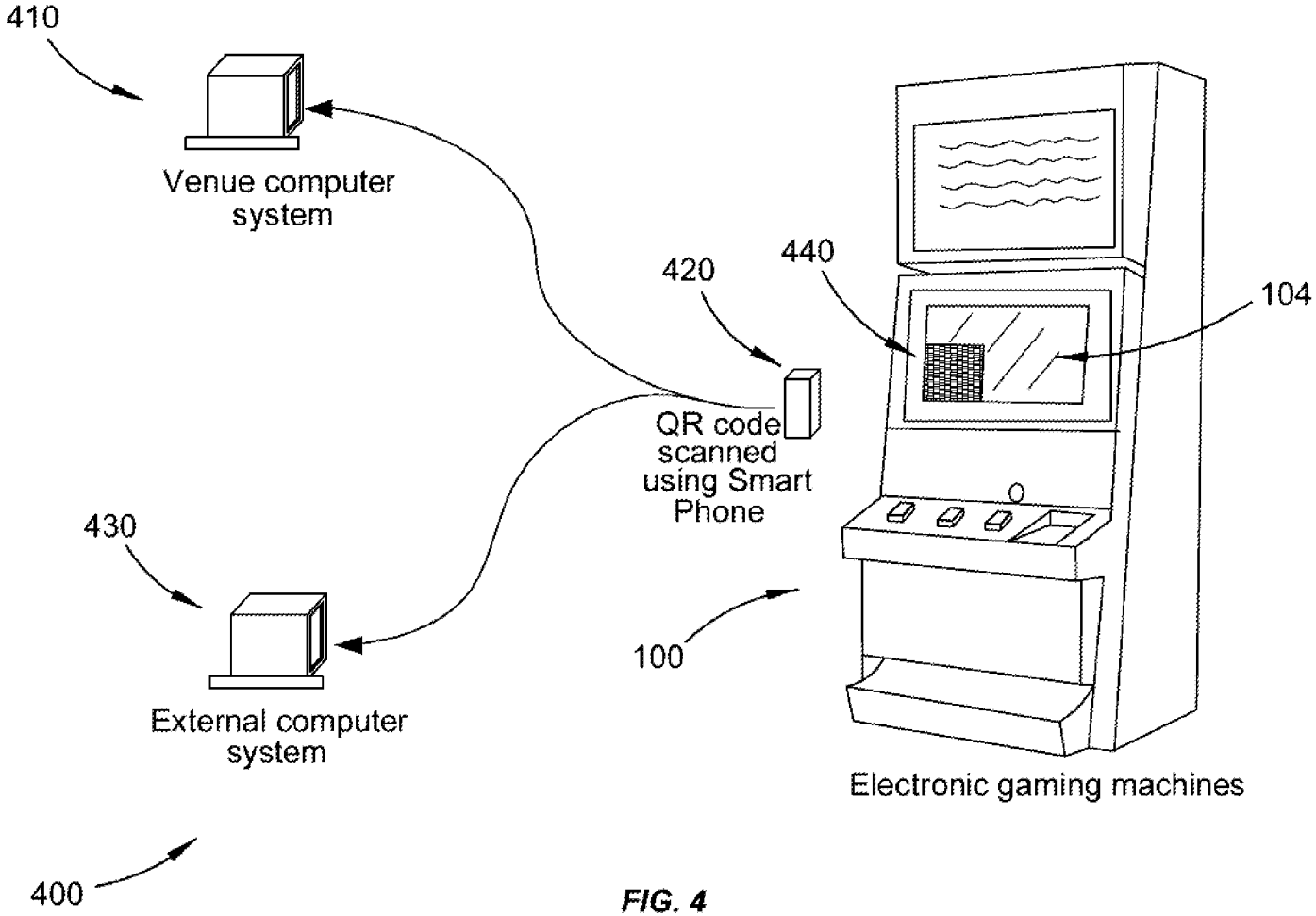
FIG. 4 shows an example system for the transferral of auditing and metering data to and from the gaming machine illustrated in FIG. 1.

FIG. 4 illustrates an example system for the transfer of information between gaming machine 100 and external devices 410, 420 and 430. In the illustrated embodiment, device 410 is a venue computer system used by the operators of gaming machine 100, for business purposes, such as account keeping and for storing data to be used for auditing; device 420 is a handheld (mobile) computing device, such as a smart mobile telephone, operated by a staff member of the venue at which gaming machine 100 is installed; and device 430 is an external computer system used by the developers of gaming machine 100 to facilitate the development of gaming machine improvements. However, this example should not be seen as limiting, and other external computing devices could receive the data or be used during the process of communicating the data in other embodiments. For example, device 420 may alternatively be an iPad, an iPod, a tablet, a digital camera or any other device with a camera installed such that an image of an encrypted visual code 440 can be captured. Device 420 may furthermore belong to a user of gaming machine 100 for purposes such as capturing points or bonuses earned during game play.

Each of computer systems 410 and 430 include at least: a processor; memory, which may be in the form of ROM or RAM; an output means for outputting information to the user, which may be a screen or speaker in some instances; and an external communication means to enable the computer system to communicate with devices external to the system. Such communication means may be in the form of a USB or Ethernet port, or the means may have wireless connection capabilities. Computer systems 410 and 430 contain program code stored in memory, capable of being executed by the processor.

Mobile device 420 comprises computing components capable of executing code and memory components capable of storing executable code and preferably other data. The stored executable code in memory includes at least one program or application capable of capturing and at least temporarily storing visual codes using the digital camera. Mobile device 420 further comprises a digital image capturing device, such as a camera or scanner, and means of communicating with external devices. This communication may be wired communication, such as a USB connector adapted to be received within a USB port on a computer or other device. Alternatively, the communication may be wireless communication using Wi-Fi or Bluetooth protocol, for example.

To transfer data, gaming machine 100 displays a visual code, illustrated as QR (quick response) code 440, on visual display 104, containing encoded information to be communicated to an external device. A user can then use the camera of the mobile device 420 to capture an image of the portion of the visual display 104 containing QR code 440. In one embodiment, the user uses a dedicated application installed and executing on the mobile device 420 to capture the image using the camera of the mobile device 420. The application reads the data contained in the code from the captured image, and decrypts a portion of it. This portion includes data that allows the user to verify that the capture was successful, such as the date and time, and the name or ID of the gaming machine. The application then communicates the captured image to devices, if any, that it has been programmed to automatically communicate with, and may give the user the option to transmit the data to other devices.

In another embodiment, the user uses any image capturing application available on mobile device 420 to capture QR code 440, and none of QR code 440 is decoded by the mobile device 420. The user then has the option to communicate the image to a number of different computing devices that will then decode the QR code 440.

In one embodiment, the QR code image can be transferred to a venue computer system 410. The user has the option of communicating the image to venue computer system 410 via a wired connection, such as USB, or through wireless means. The processor of venue computer system 410 runs program code to read the data contained in the image and decodes a portion of it. The data able to be decoded includes, for instance, information used for auditing and accounting purposes.

In the illustrated embodiment, the QR code image is also communicated to external computer system 430. In one embodiment, the image is sent by email through the mobile telephone network to a desired email address, such as an email address belonging to the developers of gaming machine 100. The recipient of the email is able to download the image file onto external computer system 430, and the program code executed by the processor of external computing device 430 then reads the data contained in the image and decodes at least a portion of it. The decoded data includes, for instance, information used to inform the recipient of the game options that were most popular among the users of the gaming machine. However, this example should not be seen as limiting, and other transferal means could be used to transfer the image from mobile device 420 to external computer system 430. For example, the image could be uploaded to an internet page portal accessible through external computer system 430.

In other embodiments, the entire QR code image is decoded by the mobile device 420, and the decoded data is then communicated to a venue computer system 410 or an external computer system 430. The mobile device 420 may store the image or any decoded data, or may discard the image or data after successfully communicating them to an external device.

In some embodiments, the QR code 440 can be printed using the printer of the gaming machine 100 and the printed QR code 440 can be subsequently scanned or imaged by a fixed imaging device or a mobile device 420 and used in a similar manner as described herein to communicate encoded information from the machine 100 to another computing device, such as computing devices 410 and/or 430.

Figure 5:
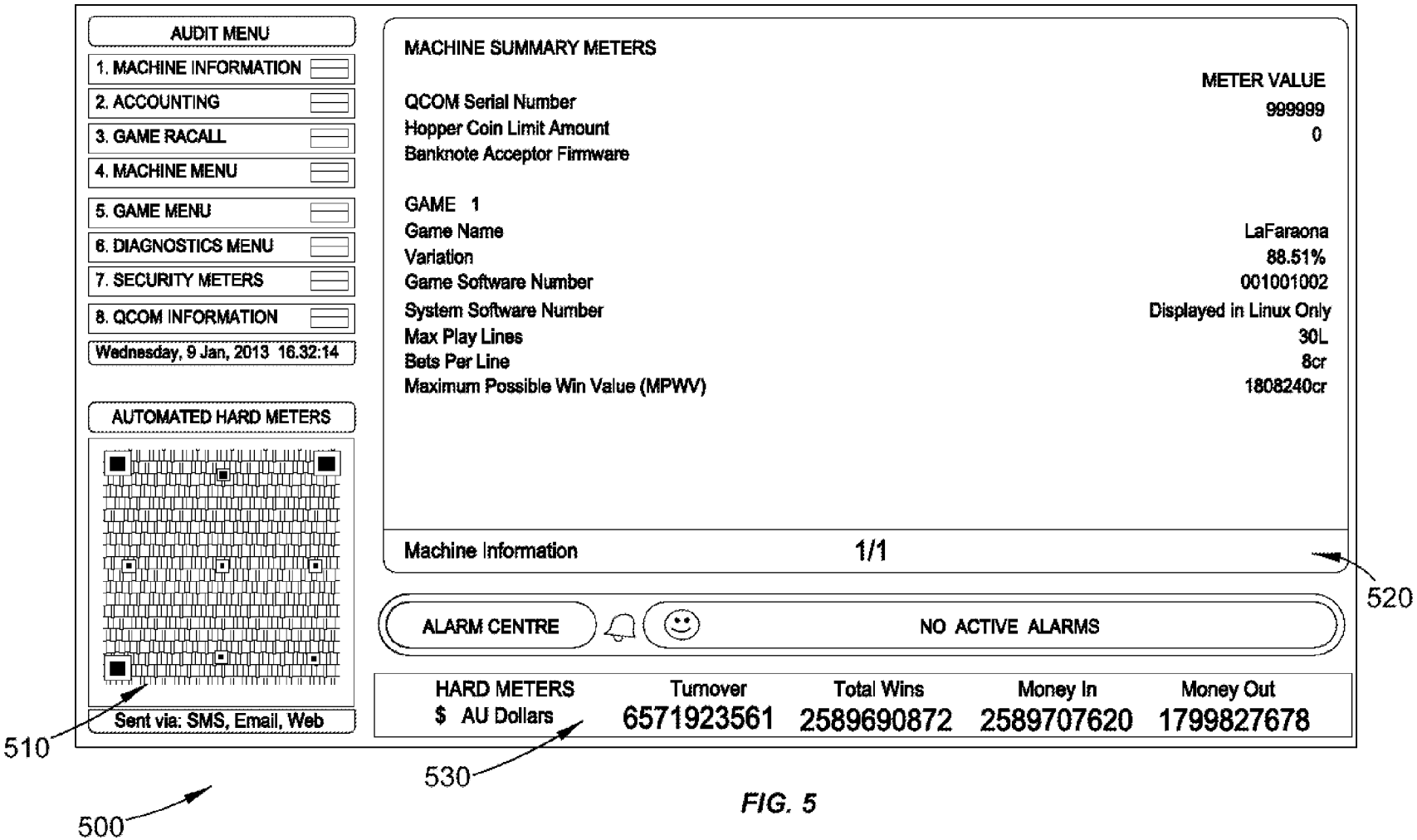
FIG. 5 shows an example display of the gaming machine illustrated in FIG. 1 illustrating an administrative screen displaying a QR code.

FIG. 5 shows an example of a screen 500 that appears on visual display 104 of gaming machine 100 to present the user with metering and auditing information. This screen is available only to authorised staff and service people, being accessible through a key operated switch, where the key required is under the control of the venue operators. In another embodiment, the screen is only available through a password protected login page. Some information is presented to the authorised user in a form that can be readily understood by an educated person, such as text and graphic displays in text panel 520 and data panel 530. Further information is contained within a visual code which must be decoded before the information becomes readily apparent to the user.

In the illustrated example, the visual code is depicted as QR code 510. QR code 510 contains statistical information about the game, and may contain some or all of the information available in text panel 520 and data panel 530, and may contain additional information not contained in text panel 520 or data panel 530. Information contained within the text panel 520 includes the QCOM serial number, the coin hopper limit amount, the game name, the software number, and the maximum possible win. Information contained within the data panel 530 includes the turnover, the total number of wins, the amount of money received by the gaming machine 100, and the amount of money dispensed by the gaming machine as a result of winnings. The QR code 510 can be printed using the printer of the gaming machine 100 and the printed QR code 510 can be subsequently scanned or imaged by a fixed imaging device or a mobile device 420 and used in a similar manner as described herein to communicate encoded information from the machine 100 to another computing device, such as computing devices 410 and/or 430.

Figure 6:
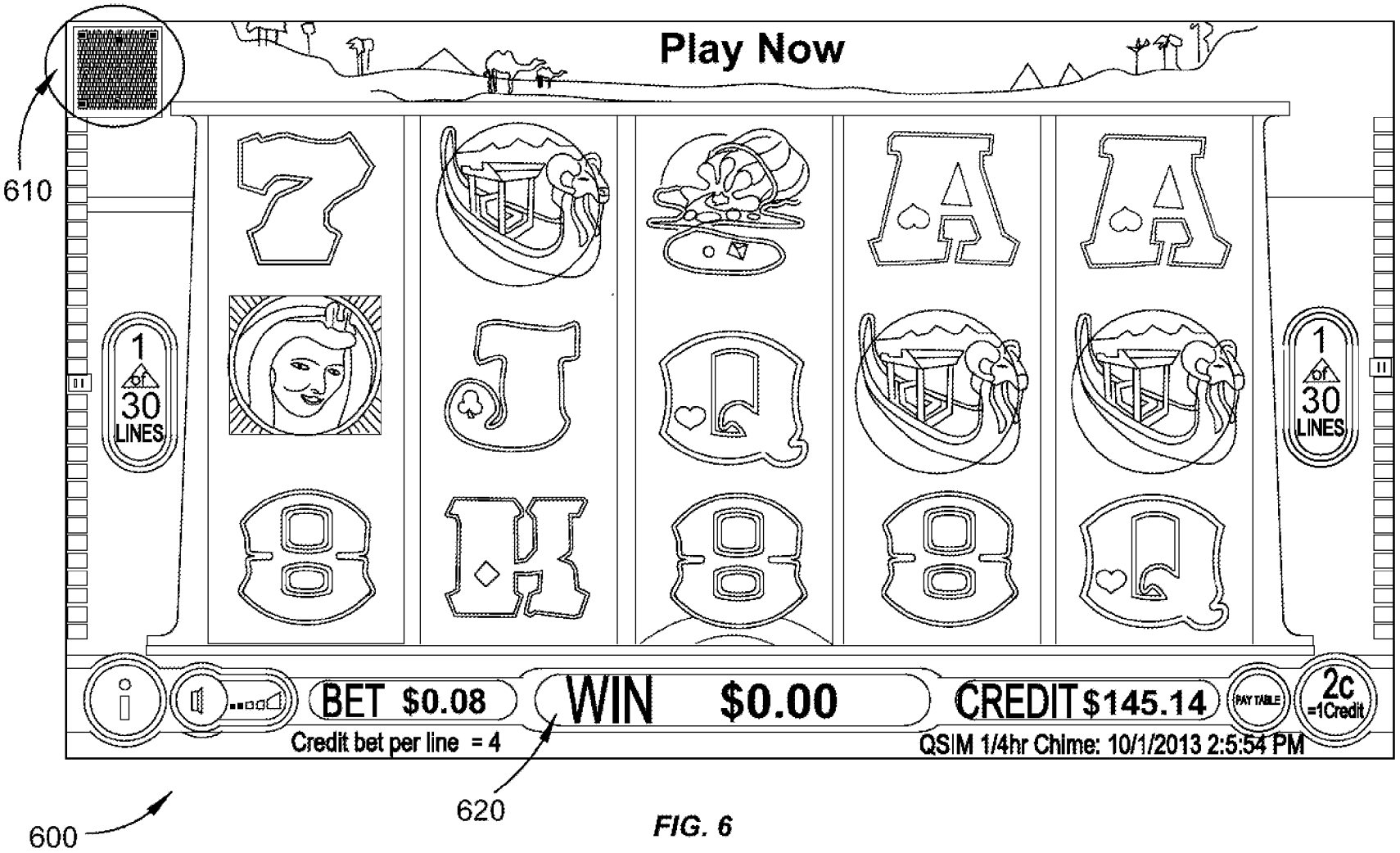
FIG. 6 shows an example display of the gaming machine illustrated in FIG. 1 illustrating a game play screen displaying a QR code.

FIG. 6 shows an example of a screen 600 that appears on visual display 104 during game play. Some information is presented to the user in text or graphic form, in data panel 620. Some information is contained within a visual code, which in this example is illustrated as a QR code 610. QR code 610 may contain some or all of the information available in data panel 620, and may contain additional information not contained in data panel 620, in some embodiments. Information contained within data panel 620 may, in some embodiments, include the amount being bet in a particular game, the amount won in a particular game and the amount of credit accumulated over a period of game play. Information contained within QR code 610 may include website addresses that provide the user with advertising material about the slot game, the gaming machine manufacture or the venue. Information may also include data about credits, points or bonuses earned by the player, or other information concerning the issuing of bonuses to players. The player may then be able to show the QR code to a staff member operating gaming machine 100 to claim their bonus. This information may be able to be captured by the user using a mobile device by photographing the screen, or by printing a docket, receipt, or other document which contains QR code 610. The staff member may then use mobile device 420 to verify and apply the bonus or credit.

The QR code 610 can be printed using the printer of the gaming machine 100 and the printed QR code 610 can be subsequently scanned or imaged by a fixed imaging device or a mobile device 420 and used in a similar manner as described herein to communicate encoded information from the machine 100 to another computing device.

Figure 7:
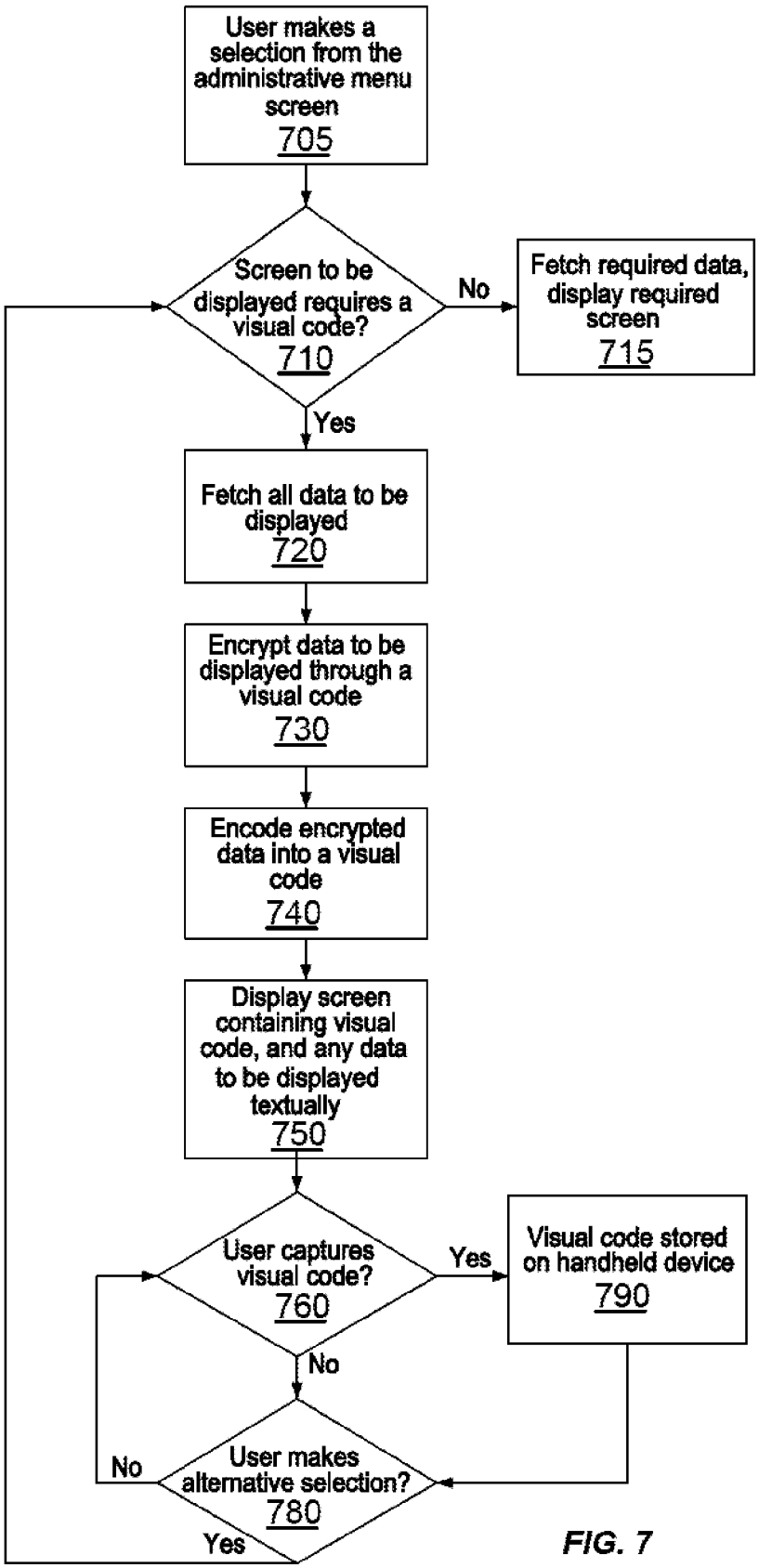
FIG. 7 shows a flow chart diagram illustrating a method of generating a visual code and capturing the code from the gaming machine illustrated in FIG. 1 to a handheld device.

FIG. 7 shows a flowchart depicting one possible method of generating the visual codes and transferring data from the gaming machine 100 to a handheld device. An administrative user of the gaming machine 100 is presented with a menu screen displayed on visual display 104 of gaming machine 100, accessible only to administrators or technical staff through a password protected login screen. The menu screen provides a number of options, allowing the user to access a variety of displays, each providing data about gaming machine 100. When the user makes a selection from the menu at 705, which may be made by pressing on the desired option using touch screen 108, their selection triggers the gaming machine 100 to display a new screen on visual display 104.

To display a screen, the system first determines whether a visual code is required for the particular screen selected at 710. If a visual code is not required, the data required for the selected display is fetched from memory and the screen displays as usual. If a visual code is required, the up-to-date data to be displayed on the screen is retrieved from memory at 720. The data that is required to be communicated via the visual code is encrypted and processed at 730. An image is generated containing the information in the form of a visual code at 740, along with a timestamp to indicate the date and time that the particular data set was generated. This image is then displayed on the screen at 750, along with the data that was flagged for display on the screen as text. Once the image appears on the screen, the user is able to capture it using a handheld device at 760, and/or select an alternative screen for display at 780. The image will remain on the screen in an unchanged state until the screen is refreshed due to the user navigating through the menus or when for instance data in an internal data store changes.

If the user captures the visual code via a handheld device, it may be stored on the handheld device at 790. In some embodiments, the dedicated application installed on the handheld device will be configured to automatically make particular communications of the data upon the capture of an image. For example, the application may be configured to automatically send the captured image to a pre-determined email address over the mobile network as soon as capture occurs. If the user selects a new screen for display, the entire process is repeated from 710, with a new visual code being generated. The code will also be regenerated when an internal data parameter such as the turnover or the total number of wins (not shown). The regeneration of the visual code allows for the data in the code to remain up-to-date, and the time stamp is necessary for auditing purposes to confirm that the data in the code was the correct data for a particular time period.

It will be appreciated by persons skilled in the art that numerous variations and/or modifications may be made to the above-described embodiments, without departing from the broad general scope of the present disclosure. The present embodiments are, therefore, to be considered in all respects as illustrative and not restrictive.

Certain steps in the processes or process flows described in this disclosure naturally precede others for the invention to function as described. However, the invention is not limited to the order of the steps described if such order or sequence does not alter the functionality of the invention. That is, it is recognized that some steps may performed before, after, or parallel (substantially simultaneously with) other steps without departing from the scope and spirit of the invention. In some instances, certain steps may be omitted or not performed without departing from the invention. Further, words such as "thereafter", "then", "next", etc. are not intended to limit the order of the steps. These words are simply used to guide the reader through the description of the exemplary method.

Additionally, one of ordinary skill in programming is able to write computer code or identify appropriate hardware and/or circuits to implement the disclosed invention without difficulty based on the flow charts and associated description in this specification, for example.

Therefore, disclosure of a particular set of program code instructions or detailed hardware devices is not considered necessary for an adequate understanding of how to make and use the invention. The inventive functionality of the claimed computer implemented processes is explained in more detail in the above description and in conjunction with the figures which may illustrate various process flows.

In one or more exemplary aspects, the functions described may be implemented in hardware, software, firmware, or any combination thereof. If implemented in software, the functions may be stored on or transmitted as one or more instructions or code on a computer-readable medium. Computer-readable media include both computer storage media and communication media including any medium that facilitates transfer of a computer program from one place to another.

A storage media may be any available media that may be accessed by a computer. By way of example, and not limitation, such computer-readable media may comprise RAM, ROM, EEPROM, CD-ROM or other optical disk storage, magnetic disk storage or other magnetic storage devices, or any other medium that may be used to carry or store desired program code in the form of instructions or data structures and that may be accessed by a computer.

Also, any connection is properly termed a computer-readable medium. For example, if the software is transmitted from a website, server, or other remote source using a coaxial cable, fiber optic cable, twisted pair, digital subscriber line ("DSL"), or wireless technologies such as infrared, radio, and microwave, then the coaxial cable, fiber optic cable, twisted pair, DSL, or wireless technologies such as infrared, radio, and microwave are included in the definition of medium.

Disk and disc, as used herein, includes compact disc ("CD"), laser disc, optical disc, digital versatile disc ("DVD"), floppy disk and blu-ray disc where disks usually reproduce data magnetically, while discs reproduce data optically with lasers. Combinations of the above should also be included within the scope of computer-readable media.

Although selected aspects have been illustrated and described in detail, it will be understood that various substitutions and alterations may be made therein without departing from the spirit and scope of the present invention.

The invention claimed is:

1. A gaming machine comprising:

a display screen;

an input mechanism operable to receive an input from a user; a gaming controller configured to:

(i) control a game play sequence comprising a presentation of one or more games of chance on the gaming machine; and (ii) in response to the received input from the user, generate and encrypt visual code from a set of data and display the encrypted visual code on the display screen, wherein the encrypted visual code includes a timestamp; wherein the displayed encrypted code is configured to be captured by an external handheld device, and the visual code is dynamically re-generated upon each successive input from a user made through the input mechanism, and wherein the set of data comprises at least a portion of the data displayed on the display screen at a time that the user activates the input mechanism.

2. The gaming machine of claim 1, wherein the generated visual code is a QR code.

3. The gaming machine of claim 1, wherein the timestamp is appended to the visual code after encryption.

4. The gaming machine of claim 1, wherein the set of data comprises values shown on the display screen representative of metering data.

5. The gaming machine of claim 4, wherein the metering data comprises at least one of hard meter data, turnover, total wins, money in and money out.

6. The gaming machine of claim 1, wherein the set of data comprises values shown on the display screen representative of at least one of: an amount of money bet in a particular game; an amount of money in a particular game; an amount of money accumulated during a particular game; and a bonus earned during a particular game.

7. The gaming machine of claim 1, wherein the input mechanism comprises one or more electromechanical push-buttons.

8. The gaming machine of claim 1, wherein the input mechanism comprises one or more virtual buttons.

9. The gaming machine of claim 1, wherein the external handheld device is configured to run an application to automatically communicate a captured image to an independent device upon capture of the image.

10. The gaming machine of claim 9, wherein the external handheld device is operable to communicate with the independent device wirelessly.

11. A method for controlling transfer of data from a gaming machine, comprising:

receiving input from a user of the gaming machine;

in response to the received user input:

generating a visual code from a set of data;

associating a timestamp with the visual code and encrypting the generated visual code;

displaying the encrypted visual code on a display screen of the gaming machine; wherein the displayed encrypted code is operable to be captured by an external handheld device, and visual code is dynamically re-generated upon each successive input from a user made via the input mechanism; and wherein generating the visual code from the set of data comprises generating the visual code from a portion of the data displayed on the display screen at a time that the user activates the input mechanism.

12. The method of claim 11, wherein generating the visual code comprises generating a QR code.

13. The method of claim 11, wherein generating the visual code from the set of data comprises generating the visual code from all of the data which is displayed on the display screen at the time that the user activates the input mechanism.

14. The method of claim 11, wherein generating the visual code from the set of data comprises generating the visual code from values shown on the display screen representative of metering data.

15. The method of claim 11, wherein generating the visual code from the set of data comprises generating the visual code from values shown on the display screen representative of at least one of: an amount of money bet in a particular game; an amount of money in a particular game; an amount of money accumulated during a particular game; and a bonus earned during a particular game.

16. A method for receiving data from a gaming machine using a handheld device, the method comprising:

capturing via the handheld device an image of an unique encrypted visual code displayed on a portion of a display screen of a gaming machine, the visual code representative of a set of data;

establishing a wireless modem connection with a remote computing device;

transmitting the captured image to the remote computing device via the wireless modem;

unencrypting the visual code and retrieving the set of data; and terminating the wireless modem connection with the remote computing device, wherein the set of data comprises at least a portion of data displayed on the display screen of the gaming machine at a time that a user activates an input mechanism of the gaming machine.

17. The method of claim 16, further comprising storing the captured image to memory in the handheld device.

* * * * *